US006181892B1

(12) United States Patent
Fujimori

(10) Patent No.: US 6,181,892 B1
(45) Date of Patent: Jan. 30, 2001

(54) IMAGE FORMING APPARATUS AND METHOD FOR DEVELOPING TONER PATCHES

(75) Inventor: Kouta Fujimori, Yokohama (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/441,670

(22) Filed: Nov. 17, 1999

(30) Foreign Application Priority Data

Nov. 17, 1998 (JP) ..... 10-342317

(51) Int. Cl.[7] ..... G03G 15/00; G03G 15/01; G03G 21/14

(52) U.S. Cl. ..... 399/72; 358/1.16; 399/49; 399/77; 399/302

(58) Field of Search ..... 399/72, 77, 49, 399/298, 302, 308; 358/1.16

(56) References Cited

U.S. PATENT DOCUMENTS

| | | | | |
|---|---|---|---|---|
| 4,684,243 | * | 8/1987 | Minor | 399/72 |
| 5,499,092 | * | 3/1996 | Sasaki | 399/302 |
| 5,970,276 | | 10/1999 | Kato . | |
| 5,991,569 | * | 11/1999 | Sugihara et al. . | |
| 6,081,678 | * | 6/2000 | Kato | 399/72 X |

FOREIGN PATENT DOCUMENTS

| | | | |
|---|---|---|---|
| 8-289162 | * | 11/1996 | (JP) . |
| 10-149009 | | 6/1998 | (JP) . |
| 10-254214 | | 9/1998 | (JP) . |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A multi-color image forming apparatus, method and computer program product storing computer instructions, wherein color information latent images corresponding to respective colors and color patch latent images corresponding to respective colors are formed on a first image bearing member, the color information and patch latent images formed on the first image being member are developed with respectively colored toners so as to form respective color toner images and color toner patches, and the color toner images and color toner patches are transferred from the first image bearing member onto a second image bearing member. The density of toner used in developing the color information and patch latent images is controlled in relation to the color toner patches. Latent image forming, developing, and transferring are controlled such that color toner images of different toner colors are transferred superimposed onto the second image bearing member, and color toner patches are transferred not superimposed onto the second image bearing member. Upon completion of formation of the superimposed color toner images of a multi-color original image, the superimposed color toner images are transferred from the second image bearing member to an image carrier and the second image bearing member is cleaned of remaining toner. In one embodiment, non-superimposition of the color toner patches is achieved by forming only a single color tonier patch for each multi-color original image and changing the color of the color toner patch in order in copying successive multi-color original images. Alternatively, color toner patches are formed spatially separate from each other on the second image bearing member.

21 Claims, 12 Drawing Sheets

FIRTST MULTI-COLOR REPRODUCTION

SECOND MULTI-COLOR REPRODUCTION

THIRD MULTI-COLOR REPRODUCTION

FOURTH MULTI-COLOR REPRODUCTION

FIRST MULTI-COLOR REPRODUCTION

SECOND MULTI-COLOR REPRODUCTION

THIRD MULTI-COLOR REPRODUCTION

FOURTH MULTI-COLOR REPRODUCTION

FIRST MULTI-COLOR REPRODUCTION

SECOND MULTI-COLOR REPRODUCTION

IMAGE FORMING APPARATUS AND METHOD FOR DEVELOPING TONER PATCHES

CROSS-REFERENCE TO RELATED APPLICATIONS

This document is based on Japanese Patent Application No. 10-342317 filed in the Japanese Patent Office on Nov. 17, 1998, and the entire contents of which are hereby incorporated by reference.

BACKGROUND OF THE INVENTION

1. Field of the Invention

The present invention relates to an image forming apparatus including a developing device having a plurality of developing units and a transfer device that transfers a developed toner image to an image bearing member, and more particularly to an image forming apparatus in which developed toner patches we employed to control toner density.

2. Discussion of the Background

A developing device of an image forming apparatus using electrophotographic image-forming and electrostatic latent image writing employs a two-component developer of a mixture of toner and carrier. Especially in a color image forming apparatus that forms full and multi-color images electrophotographically, the developing device generally employs a two-component developer to produce a color image. In the two-component developer, a toner density control (i.e., a ratio between toner and carrier by weight) is a very important factor to obtain a desired image quality. For example, when toner is used to develop a latent image on an image bearing member such as a photoconductive member, the amount and density of toner decrease in the two-component developer.

In order to maintain a desired image quality, it is necessary precisely to detect the toner density in the developer, to supply toner according to the consumed amount, and to control toner density at a certain value.

In a background method of measuring toner density in a developer, a latent image of toner patch having a generated toner pattern is formed, for example, in a 20 mm by 20 mm square, during each image forming process on an image bearing member (i.e., a photoconductive member) in a non-image area on the image bearing member, that is, in an area between image forming areas. The latent image of the toner patch is developed by toner, and then the amount of toner on the toner patch is measured by a reflection type optical sensor. The toner density is controlled by maintaining a standard value of toner density.

The above-described toner density measuring method has been increasingly employed in a full color copier, too. The full color copier has a plurality of developing units, and the density of toner in each color developing unit is required to be kept adequately for a desired image quality. In a color image forming process, each toner image developed by each color toner on a first image bearing member (i.e., a photoconductive member) is transferred to a second image bearing member (i.e., a transfer belt) each time color image forming is performed and is superimposed on the surface thereof with the leading edge of each color toner image aligned. The above-described toner patches developed by each color toner in a non-image area on the first image bearing member are also transferred to the second image bearing member and superimposed on the surface thereof.

Immediately after transferring a toner image and a toner patch to the second image bearing member, a residual toner on the first image bearing member is cleaned by a first cleaning device for image forming and developing of a next color image. On the second image bearing member, full color toner images and toner patches are superimposed thereon, and only full color toner images are transferred to a transfer sheet. Superimposed toner patches remain on the second bearing member. Then, a second cleaning device including a cleaning blade cleans residual toner and the superimposed toner patches on the second image bearing member. Because the cleaning blade needs to scrape the superimposed toner patches strongly, the load on the second cleaning device increases. As a result, a vibration of the cleaning blade occurs, and the residual toner and toner patches remain on the second image bearing member without being adequately cleaned. Toner remaining on the second image bearing member stains the next color toner image transferred from the first image bearing member.

Japanese Laid-open Patent Publication No. 10-149009 describes an image forming apparatus in which toner patches for measuring and controlling the density of toner are formed in a line along the longitudinal direction of a photoconductive drum. In this image forming apparatus, a plurality of photo sensors of a toner density detecting device detect each toner patch. However, such a mechanism for the toner density detecting device increases the cost of the image forming apparatus.

SUMMARY OF THE INVENTION

The present invention has been made in view of the above-discussed problems, and an object of the invention is to provide a novel image forming apparatus and method that can clean a residual tone, and toner patches on an image bearing member without causing load on a cleaning device.

These and other objects are achieved according to the present invention by providing a novel multi-color image forming apparatus, method and computer program product storing computer instructions, wherein color information latent images corresponding to respective colors and color patch latent images corresponding to respective colors are formed on a first image bearing member, the color information and patch latent images formed on the first image bearing member are developed with respectively colored toners so as to form respective color toner images and color toner patches, and the color toner images and color toner patches are transferred from the first image bearing member onto a second image bearing member. The density of toner used in developing the color information and patch latent images is controlled in relation to the color toner patches. Latent image forming, developing, and transferring are controlled such that color toner in ages of different toner colors are transferred superimposed onto the second image bearing member, and color toner patches are transferred not superimposed onto the second image bearing member. Upon completion of formation of the superimposed color toner images of a multi-color original image, the superimposed color toner images are transferred from the second image bearing member to an image carrier and the second image bearing member is cleaned of remaining toner. In one embodiment, non-superimposition of the color toner patches is achieved by forming only a single color toner patch for each multi-color original image and changing the color of the color toner patch in order in copying successive multi-color original images. Alternatively, color toner patches are formed spatially separate from each other on the second image bearing member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
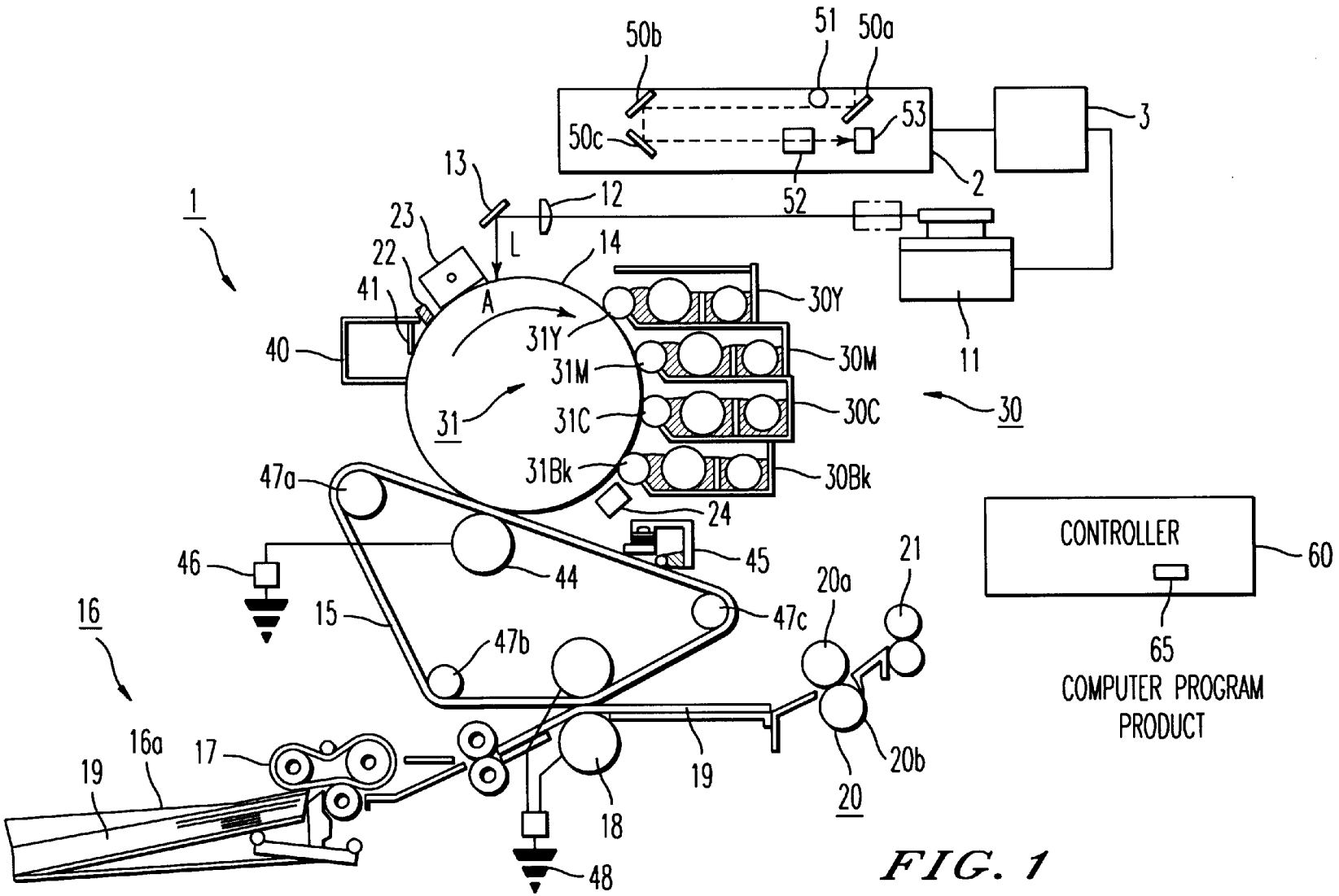
FIG. 1 is a schematic illustration of a color image forming apparatus of a multiple transfer process according to an embodiment of the present invention.

Referring now to the drawings, wherein like reference numerals designate identical or corresponding parts throughout the several views, FIG. 1 is a schematic view of a color image forming apparatus of a multiple transfer process according to the embodiment of the present invention. The color image forming apparatus of the present invention includes an image-input device 2, an image-processing device 3, and an image-printing device 1.

The image-input device 2 illuminates an original document (not shown) with a halogen lamp 51 to form an image of the original document on a color sensor 53 through an imaging system including mirrors 50*a,* 50*b,* and 50*c,* and a lens 52. The color sensor 53 includes a color separating device to separate colors of light to red (R), green (G), and blue (B) and a photoelectric conversion device, such as a charge coupled device (CCD), to convert each of the separated colors into electric signals.

The image-processing device 3 converts the R, G, and B color signals into a set of color image data including black (Bk), yellow (Y), magenta (M), and cyan (C) image data, and sends the color image data to the image-printing device 1.

The image-printing device 1 forms a corresponding visible color toner image synchronously with receiving one of the Bk, Y, M, and C image data from the image-processing device 3, and repeats the image forming operation four times, and superimposed each color toner image to form a four-color toner image.

A main configuration of the image-printing device 1 will be described hereinafter. A laser writing device 11 converts color image data from the image-processing device 3 into optical signals and exposes a photoconductive drum 14 with the optical signals to form a latent image corresponding to the image of an original document. The laser writing device 11 includes a laser diode (not shown), a laser driver controller (not shown), a polygonal mirror (not shown), a motor (not shown) for driving the polygonal mirror, an f-theta lens 12, a reflecting mirror 13, and etc. A laser beam emitted from the laser writing device 11 to the surface of the photoconductive drum 14 is indicated by an arrow L in FIG. 1.

The photoconductive drum 14 rotates in the direction indicated by an arrow A in FIG. 1. Around the photoconductive drum 14, there are arranged a discharging device 22, a cleaning device 40, a charger 23, a black-developing unit 30Bk, a yellow-developing unit 30Y, a magenta-developing unit 30M, a cyan-developing unit 30C, and an intermediate transfer belt 15. The developing units 30Bk, 30Y, 30M, and 30C (hereinafter may be referred to as developing units 30 as a whole) respectively include developer carriers 31Bk, 31Y, 31M, and 31C (hereinafter may be referred to as developer carriers 31 as a whole) that contact a surface of the photoconductive drum 14 and rotate to develop latent images on the photoconductive drum 14 with developer. When the image forming apparatus is in a standby condition, each one of the developer carriers 31 of the developing units 30 does not contact the surface of the photoconductive drum 14. In this embodiment, the developing units 30 develop latent images by each color toner in the order of black, yellow, magenta, and cyan. However, the order of color image forming is not limited to the above-described order, but any order is possible.

Below the photoconductive drum 14, an intermediate transfer belt 15 is provided for transferring each color toner image developed on the photoconductive drum 14 thereto and for superimposing each color toner image thereon.

As a transfer device, there are two types: "corona discharging type" and "contact type." In the transfer device of the corona discharging type, a toner image on an image bearing member (e.g., a photoconductive member) is transferred to a transfer material by applying electric charge to a backside of the transfer material by a corona-charger. The corona-charger does not contact the transfer material.

In the transfer device of the contact type, a transfer roller contacts the transfer material, and bias voltage is applied to the transfer roller to transfer a toner image from the image bearing member to the transfer material. The transfer device of the color image forming apparatus in FIG. 1 is a contact type. The contact type transfer device has advantage because the transfer voltage is reduced and the transfer device can be compact and low cost.

The color toner image on the photoconductive drum 14 is transferred to the intermediate transfer belt 15 by applying bias voltage from a transfer power supply 46 to a transfer roller 44. The intermediate transfer belt 15 is rotatatively driven around rollers 47*a,* 47*b,* and 47*c.* It is preferable that the intermediate transfer belt 15 be made of a material whose electrical resistance changes less by an environmental condition such as, for example, humidity. An elastic material such as a chloroprene rubber, an ethylene-propylene-diene-methylene (EPDM) rubber, a silicone rubber, or the like can be useful for that reason. Further, in order to control electrical resistance, carbon black, zinc oxide, and etc. may be added to the above-described elastic material. Furthermore, the elastic material may be coated with fluororesin or the like.

After transferring a four-color toner image to the intermediate transfer belt 15, residual toner on the photoconductive drum 14 is removed by a rubber blade 41 of the cleaning device 40, and then the photoconductive drum 14 is uniformly discharged by the discharging device 22 to be prepared for a next image forming operation.

A pair of transfer rollers 18 is normally separate from the intermediate transfer belt 15. However, when a four-color toner image superimposed on the intermediate transfer belt 15 is to be transferred to a transfer sheet 19, the transfer rollers 18 abuts on the intermediate transfer belt 15 with an appropriate timing. A predetermined bias voltage is applied to the transfer rollers 18 from a transfer power supply 48, and the four-color toner image is transferred to the transfer sheet 19.

After the four-color toner image on the intermediate transfer belt 15 is transferred to the transfer sheet 19, a belt cleaning device 45 cleans the surface of the intermediate transfer belt 15. Urethane rubber or the like is a preferable material to be used for a cleaning blade (not shown) of the belt cleaning device 45.

In a sheet feeding device 16, the transfer sheet 19 is fed to a sheet feeding roller 17 from a sheet feeding cassette 16*a*, and then the sheet feeding roller 17 rotates to feed the transfer sheet 19 at a timing such that a leading edge of the four-color toner image on the intermediate transfer belt 15 is aligned with a leading edge of the transfer sheet 19. The transfer sheet 19 with four-color toner image transferred thereon is further transferred to a fixing device 20 by a sheet feeding unit (not shown). Then, the transferred four-color toner image is fused and fixed to the transfer sheet 19 passing between a fixing roller 20*a* and a pressure roller 20*b* which are kept at a predetermined temperature. Finally, the transfer sheet 19 is discharged from the image forming apparatus as a full color copy sheet.

An optical sensor 24 which measures the amount of toner adhered to the photoconductive drum 14 is provided downstream of the developing units 30 so as to control the density of toner in the developing units 30. The optical sensor 24 includes a light-emitting diode device (hereinafter referred to as an LED device) and a photodiode. The amount of adhered toner is measured as follows. When the LED device emits a light to the toner developed on the photoconductive drum 14, the photodiode receives reflected light from the toner developed on the photoconductive drum 14. An analog to digital (A/D) converter (not shown) converts the amount of received light to digital light amount signals. Then a central processing unit (CPU) (not shown) measures toner amount based on light amount signals of each color, and calculates toner density of each color toner in the developer by computation preset for each color toner. When the calculated value of toner density is smaller than the predetermined value, the CPU outputs a toner supply signal, and a toner supply unit (not shown) supplies each toner to the developing units 30 so as to keep the toner density of the developer at a predetermined value.

Figure 2A:
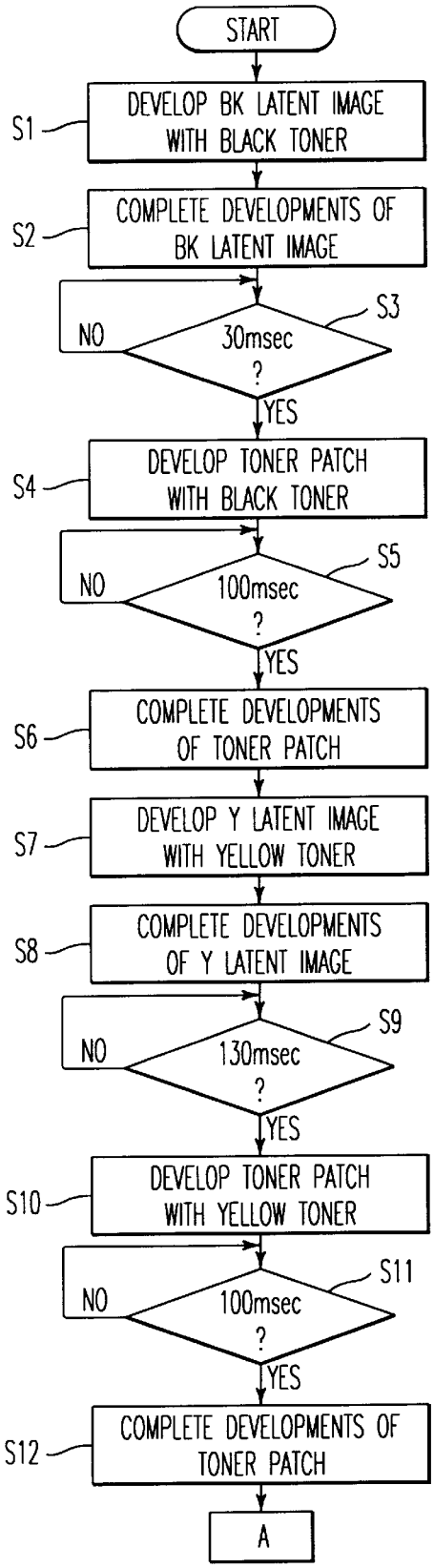
FIG. 2 is a flowchart of developing process steps when one copy of a four-color toner image is formed according to a first embodiment of the present invention.
Figure 2B:
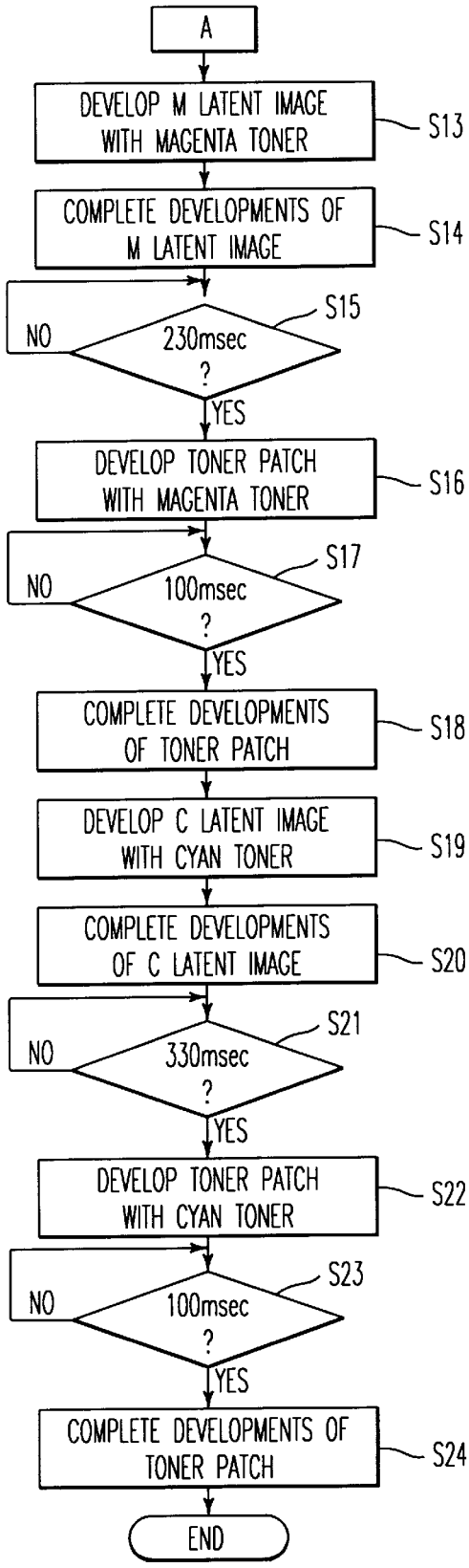

A first embodiment of the present invention will be described referring to FIGS. 1 through 4. FIG. 2 is a flowchart of developing process steps when one copy of a four-color toner image is formed.

To start a copying operation, the photoconductor drum 14 is rotated and uniformly charged by the charger 23. Then the image-input device 2 starts illuminating an original document at a predetermined timing and obtains electric signals of a black image. Further, the image-processing device 3 converts the electric signals of a black image into black image data and sends the black image data to the laser writing device 11. The laser writing device 11 converts the black image data into optical signals and exposes the photoconductive drum 14 with the optical signals to form a latent image. The latent image according to the black image data is hereinafter referred to as a "Bk latent image", and similarly a yellow latent image according to yellow image data, a magenta latent image according to magenta image data, and a cyan latent image according to cyan image data are referred to as "Y latent image", "M latent image", "C latent image", respectively.

The black-developing unit 30Bk in a standby condition moves closer to the photoconductive drum 14 to cause the black developer carrier 31Bk to contact the photoconductive drum 14 before the leading edge of the black latent image area reaches a developing position. Upon contacting the photoconductive drum 14, the black developer carrier 31Bk starts rotating to develop the Bk latent image with black toner in step S1. Then, the black developer carrier 31Bk completes development after the trailing edge of the Bk latent image is developed with black toner in step S2. The CPU judges if 30 milliseconds are elapsed after the black developer carrier 31Bk completes the development for the Bk latent image in step S3. If the answer is YES in step S3, the black developer carrier 31Bk starts developing a toner patch with black toner in a non-image area on the photoconductive drum 14 in step S4. If the answer is NO in step S3, the developing process returns to reexecute step S3. Then, the CPU judges if 100 milliseconds are elapsed after the black developer carrier 31BK starts developing a toner patch with black toner in step S5. If the answer is YES in step S5, the black developer carrier 31Bk completes the developments for the toner patch with black toner in step S6. If the answer is NO in step S5, the developing process returns to reexecute step S5. The above-described black developing process and cleaning and recharging of the photoconductive drum 14 are completed before Y latent image formation. While the black-developing unit 30Bk develops, the yellow-developing unit 30Y, magenta-developing unit 30M, and cyan-developing unit 30C are not in contact with the photoconductive drum 14 and are in a standby condition. After the toner patch is developed with black toner in step S6, the optical sensor 24 measures the amount of black toner on the toner patch.

The black toner image and black toner patch developed on the photoconductive drum 14 are transferred to the intermediate transfer belt 15, which is rotated by a belt drive motor (not shown) at substantially the same surface velocity as that of the photoconductive drum 14, by applying bias voltage to the transfer roller 44 from the transfer power supply 46 and by generating electrode potential on the surface of the intermediate transfer belt 15. After transferring the black toner image and black toner patch to the intermediate transfer belt 15, the photoconductive drum 14 is cleaned by the cleaning device 40 and discharged by the discharging device 22, and then is uniformly charged by the charger 23.

After the black image forming operation, the yellow image forming operation starts in the image forming apparatus. The image-input device 2 starts illuminating the original document at a predetermined timing and obtains electric signals of a yellow image. Then, the image-processing device 3 converts the electric signals of a yellow image into yellow image data and sends the yellow image data to the laser writing device 11. The laser writing device 11 converts the yellow image data into optical signals and exposes the photoconductive drum 14 with the optical signals to form a Y latent image.

Before the leading edge of the Y latent image reaches the developing position, the yellow-developing unit 30Y in a standby condition moves closer to the photoconductive drum 14 to cause the yellow developer carrier 31Y to contact the photoconductive drum 14. Upon contacting the photoconductive drum 14, the yellow developer carrier 31Y starts rotating to develop the Y latent image with yellow toner in step S7. Then, the yellow developer carrier 31Y completes development after the trailing edge of the Y latent image is developed with yellow toner in step S8. The CPU judges if 130 milliseconds are elapsed after the yellow developer carrier 31Y completes the development for the Y latent image in step S9. If the answer is YES in step S9, the yellow developer carrier 31Y starts developing with yellow toner in step S10 a toner patch in a non-image area on the photoconductive drum 14. Then, in step S11 the CPU judges if 100 milliseconds are elapsed after the yellow developer carrier 31Y starts developing a toner patch with yellow toner. If the answer is YES in step S11, the yellow developer carrier 31Y completes the development for the toner patch with yellow toner in step S12. The above-described yellow developing process and cleaning and recharging of the photoconductive drum 14 are completed before M latent image formation. While the yellow-developing unit 30Y develops, the Y latent image, the other black-developing unit 30Bk, magenta-developing unit 30M, cyan-developing unit 30C are not in contact with the photoconductive drum 14 and are in a standby condition. After the toner patch is developed with yellow toner in step S12, the optical sensor 24 measures the amount of yellow toner on the yellow toner patch.

Figure 3A:
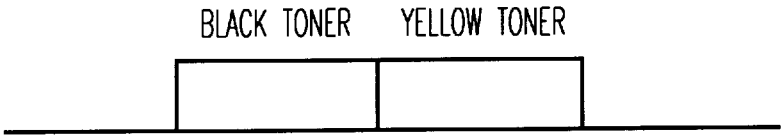
FIG. 3A is an illustration of black and yellow toner patches on an intermediate transfer belt.

The yellow toner image and yellow toner patch developed on the photoconductive drum 14 are transferred to the surface of the intermediate transfer belt 15 by applying bias voltage to the transfer roller 44 as described earlier. As illustrated in FIG. 3A, the black toner patch and yellow toner patch are not superimposed on the intermediate transfer belt 15 by changing the start time for developing each toner patch after the Bk latent image and Y latent image are completed to be developed in steps S2 and S8.

Following the black and yellow developing process a similar developing process for magenta and cyan is repeated subsequently. The magenta developer carrier 31M starts developing an M latent image with magenta toner in step S13. Then, the magenta developer carrier 31M completes development after the trailing edge of the M latent image is developed with magenta toner in step S14. The CPU judges if 230 milliseconds are elapsed after the magenta developer carrier 31M completes the development for the M latent image in step S15. If the answer is YES in step S15, the magenta developer carrier 31M starts developing a toner patch on the photoconductive drum 14 with magenta toner in step S16. Then, the CPU judges if 100 milliseconds are elapsed after the magenta developer carrier 31M starts developing a toner patch with magenta toner in step S17. If the answer is YES in step S17, the magenta developer carrier 31M completes the development for the toner patch with magenta toner in step S18. After the toner patch is developed with magenta toner in step S18, the optical sensor 24 measures the amount of magenta toner on the toner patch. The magenta toner image and magenta toner patch developed on the photoconductive drum 14 are transferred to the intermediate transfer belt 15 similarly as in the black and yellow image forming operations.

Figure 3B:
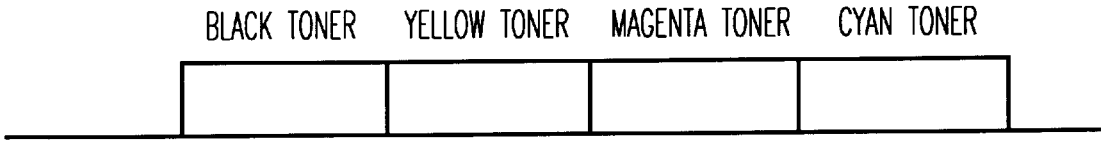
FIG. 3B BACKGROUND ART
FIG. 3B is an illustration of black, yellow, magenta, and cyan toner patches on the intermediate transfer belt.
Figure 4:
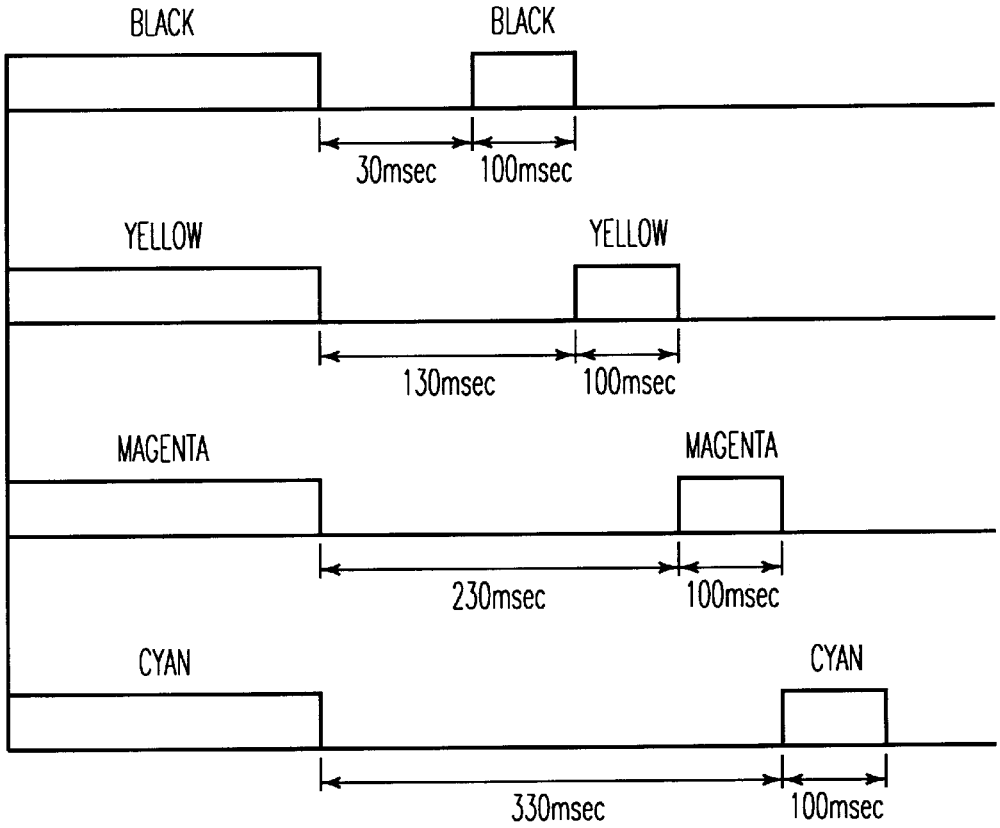
FIG. 4 is a timing chart of developing process according to the first embodiment of the present invention.

After the magenta developing process, the cyan developer carrier 31C starts developing a C latent image with cyan toner in step S19. Then, cyan developer carrier 31C completes development after the trailing edge of the C latent image is developed with cyan toner in step S20. The CPU judges if 330 milliseconds are elapsed after the cyan developer carrier 31C completes the developments for the C latent image in step S21. If the answer is YES in step S21, the cyan developer carrier 31C starts developing a toner patch on the photoconductive drum 14 with cyan toner in step S22. Then, the CPU judges if 100 milliseconds are elapsed after the cyan developer carrier 31C starts developing a toner patch with cyan toner in step S23. If the answer is YES in step S23, the cyan developer carrier 31C completes the development for the toner patch with cyan toner in step S24. After the toner patch is developed with cyan toner in step S24, the optical sensor 24 measures the amount of cyan toner on the toner patch. The cyan toner image and cyan toner patch developed on the photoconductive drum 14 are transferred to the intermediate transfer belt 15 similarly as in the black, yellow, and magenta image forming operations. Thereby, toner images for black, yellow, magenta, and cyan are subsequently transferred to the same surface of the intermediate transfer belt 15 with the leading edge of each color toner image aligned, and are superimposed thereon. Thereafter, the four superimposed color toner images are transferred to the transfer sheet 19 at one time. As is illustrated in FIG. 3B and FIG. 4, toner patches of each color are transferred to the intermediate transfer belt 15 consecutively without being superimposed. Although the developing time for each toner patch is set 100 milliseconds in the first embodiment, the developing time (i.e., a size of toner patch) can be changed depending on the line velocity of the photoconductive drum 14 and the sensitivity of the optical sensor 24. For example, when the line velocity of the photoconductive drum 14 is lower, the size of toner patch can be smaller. Even when the size of toner patch is decreased and the line velocity of the photoconductive drum 14 is maintained at a normal speed or a high speed, the optical sensor 24 can detect the toner density of the developer if an optical sensor 24 having high sensitivity is used.

When copies of four-color toner images are performed in the image forming apparatus according to the first embodiment, cleaning failure and vibration of the cleaning blade of the belt cleaning device 45 do not occur after printing 10,000 sheets of four-color toner images successively.

Figure 3C:
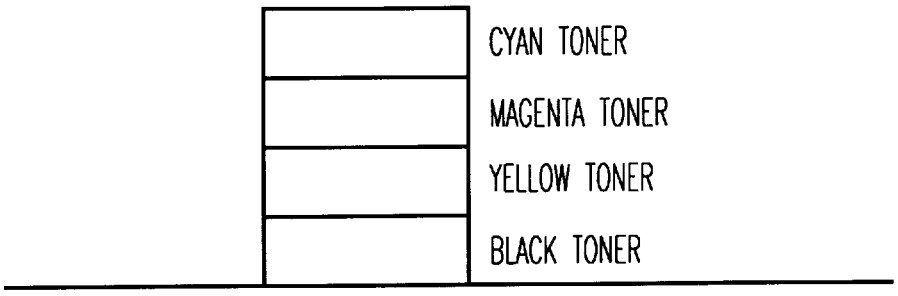
FIG. 3C is an illustration of black, yellow, magenta, and cyan toner patches in an image forming apparatus of background method of developing toner patch.

On the other hand, in the image forming apparatus of the background method of developing toner patch, e.g., four-color toner images are formed and each toner patch of black, yellow, magenta, and cyan is transferred and superimposed on the same place of an intermediate transfer belt as illustrated in FIG. 3C, toner streaks appear over an image extending in the intermediate transfer belt moving direction due to cleaning failure, and toner streaks appear over an image extending in the direction orthogonal to the intermediate transfer belt moving direction due to the vibration of the cleaning blade after printing 10,000 sheets of four-color toner images successively.

Figure 5A:
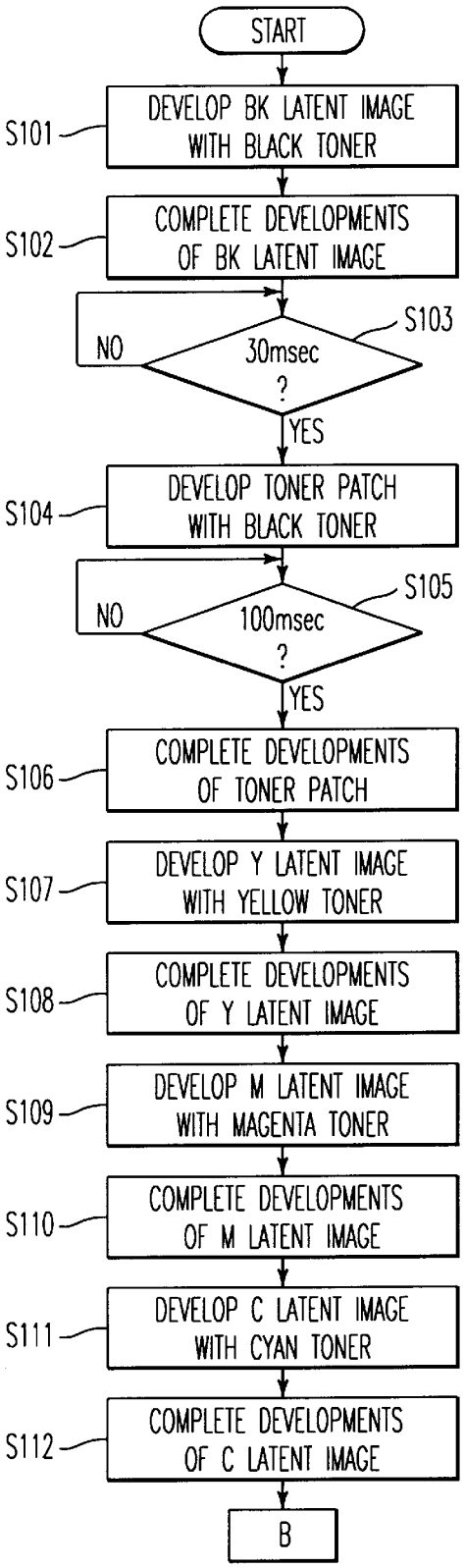
FIGS. 5 and 6 are flowcharts of developing process steps when four copies of the same four-color toner image are formed according to a second embodiment of the present invention.
Figure 5B:
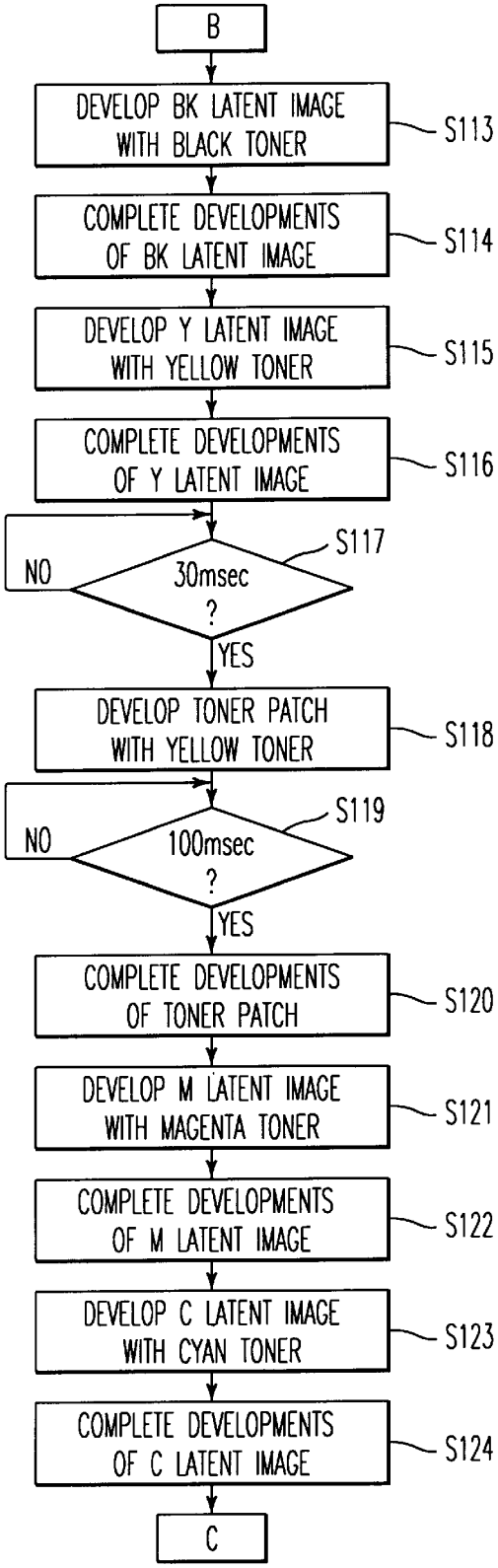
Figure 6A:
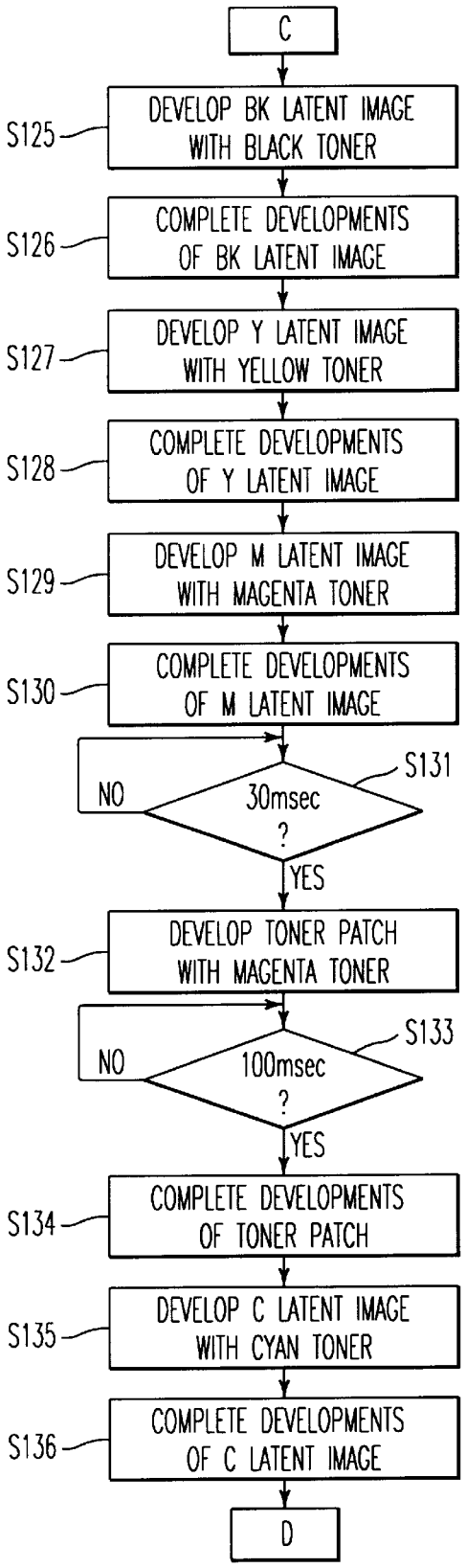
Figure 6B:
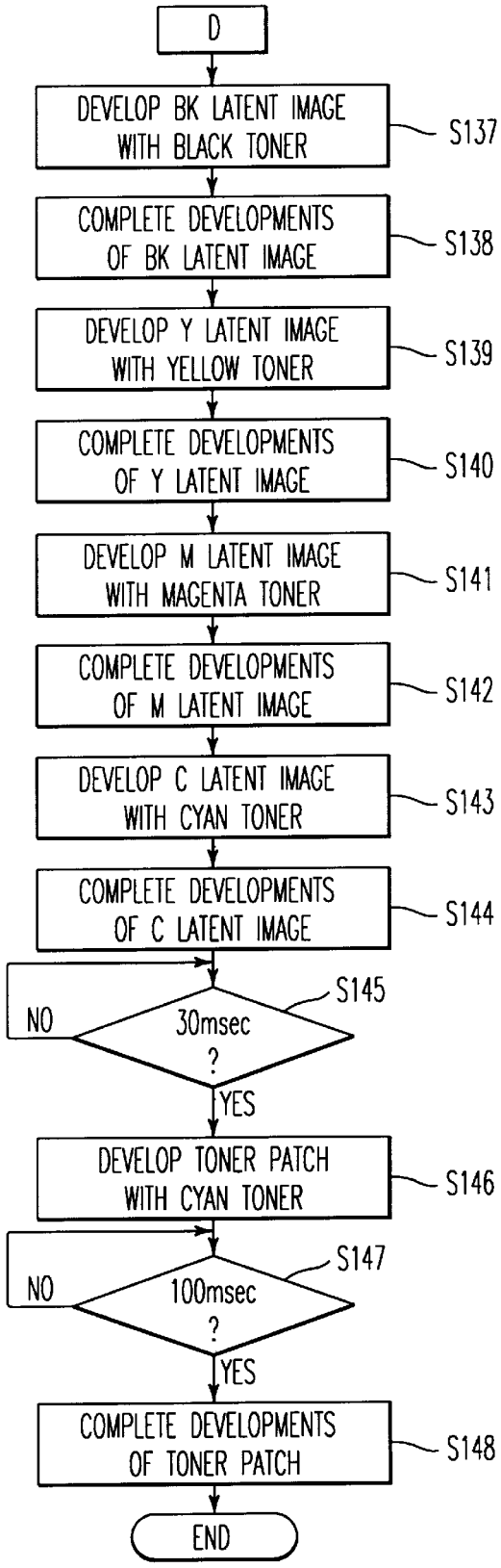

A second embodiment of the present invention will be described referring to FIGS. 5 through 7. FIGS. 5 and 6 are flowcharts of developing process steps when multiple copies, in this example four copies, of the same four-color toner image are formed.

Figure 7A:
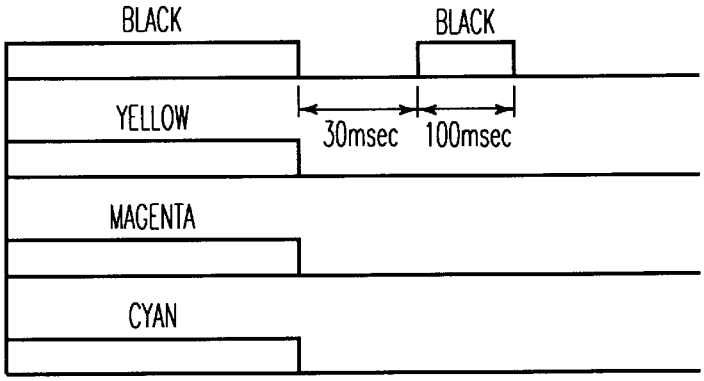
FIGS. 7A through 7D are timing charts of a developing process according to the second embodiment of the present invention.

After a copying operation starts, the black developer carrier 31Bk starts developing a Bk latent image with black toner in step S101 and completes development in step S102. Then, in step S103 the CPU judges if 30 milliseconds are elapsed after the black developer carrier 31Bk completes the development in step S102. If the answer is YES in step S103, the black developer carrier 31Bk starts developing a toner patch on the photoconductive drum 14 with black toner in step S104. Then, in step S105 the CPU judges if 100 milliseconds are elapsed after the black developer carrier 31Bk starts developing the toner patch with black toner. If the answer is YES in step S105, the black developer carrier 31Bk completes the development for the toner patch with black toner in step S106. After developing the toner patch with black toner in step S106, the optical sensor 24 measures the amount of black toner on the toner patch. After step S106, the developing operations are successively performed for each of the Y, M and C latent images in steps S107 through S112. The above-described developed images for each color and the black toner patch are transferred to the intermediate transfer belt 15 after each development. As a result, four-color toner images are superimposed and the black toner patch is formed on the intermediate transfer belt 15 as illustrated in FIG. 7A. Thereafter, the superimposed four-color toner images are transferred to the transfer sheet 19 by the transfer rollers 18. The residual toner and the black toner patch on the intermediate transfer belt 15 are cleaned by the belt cleaning device 45.

Figure 7B:
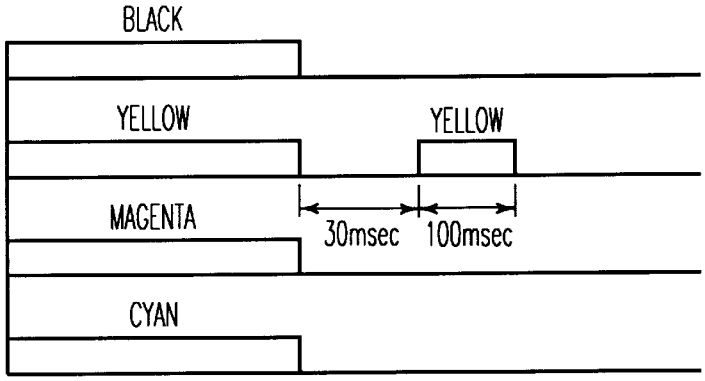

Next, the developing process for the second copy continues from step S113 to step S124. The black developer carrier 31Bk starts developing a Bk latent image with black toner in step S113 and completes development in step S114. Then, the yellow developer carrier 31Y starts developing an Y latent image with yellow toner in step S115 and completes development in step S116. After step S116, in step S117 the CPU judges if 30 milliseconds are elapsed after the yellow developer carrier 31Y completes the development. If the answer is YES in step S117, the yellow developer carrier 31Y starts developing a toner patch on the photoconductive drum 14 with yellow toner in step S118. Then, in step S119 the CPU judges if 100 milliseconds are elapsed after the yellow developer carrier 31Y starts developing the toner patch with yellow toner. If the answer is YES in step S119, the yellow developer carrier 31Y completes the development for the toner patch with yellow toner in step S120. After step S120, the optical sensor 24 measures the amount of yellow toner on the toner patch. Then, the developing operations are performed for each M and C latent images successively in steps S121 through S124. After transferring, four superimposed color toner images and the yellow toner patch are formed on the intermediate transfer belt 15 as illustrated in FIG. 7B. Thereafter, the four superimposed color toner images are transferred to the transfer sheet 19 by the transfer rollers 18. The residual toner and the yellow toner patch on the intermediate transfer belt 15 are cleaned by the belt cleaning device 45.

Figure 7C:
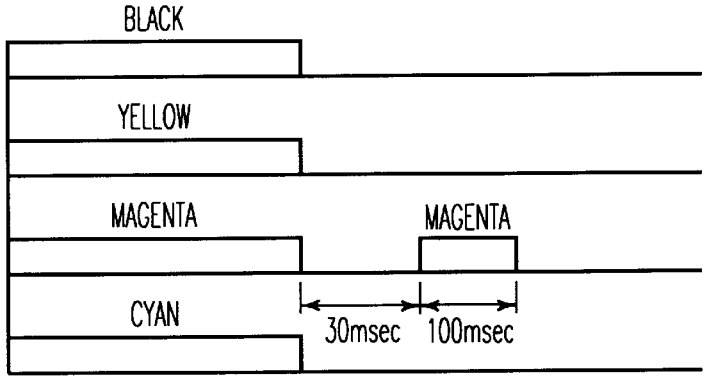

Referring to FIG. 6, the developing process for the third copy continues from step S125 to step S136. The developing operations are performed for each BK, Y, and M latent image successively in steps S125 through S130. After step S130, the CPU judges if 30 milliseconds are elapsed after the magenta developer carrier 31M completes the development in step S131. If the answer is YES in step S131, the magenta developer carrier 31M starts developing a toner patch on the photoconductive drum 14 with magenta toner in step S132. Then, the CPU judges if 100 milliseconds are elapsed after the magenta developer carrier 31M starts developing the toner patch with magenta toner in step S133. If the answer is YES in step S133, the magenta developer carrier 31M completes the development for the toner patch with magenta toner in step S134. After step S134, the optical sensor 24 measures the amount of magenta toner on the toner patch. Then, the developing operations are performed for a C latent image in steps S135 and S136. Likewise, four color toner images are superimposed and magenta toner patch is formed on the intermediate transfer belt 15 as illustrated in FIG. 7C. After transferring the four superimposed color toner images to the transfer sheet 19 by the transfer rollers 18, the residual toner and the magenta toner patch on the intermediate transfer belt 15 are cleaned by the belt cleaning device 45.

Figure 7D:
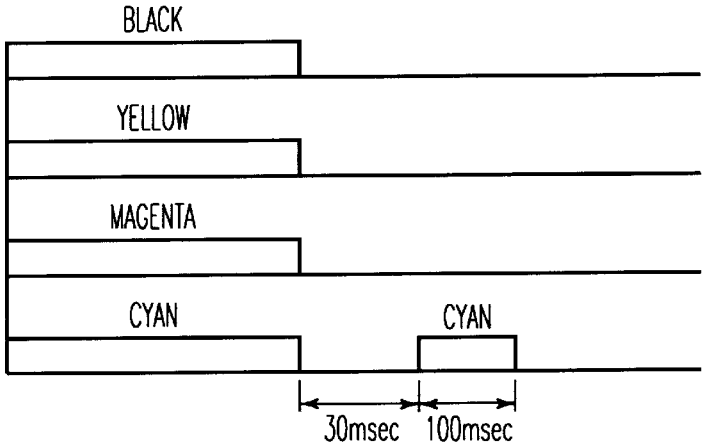

Lastly, the developing process for the fourth copy continues from step S137 to step S148. The developing operations are performed for each Bk, Y, M, and C latent images successively in steps S137 through S144. After step S144, the CPU judges if 30 milliseconds are elapsed after the cyan developer carrier 31C completes the development in step S145. If the answer is YES in step S145, in step S146 the cyan developer carrier 31C starts developing a toner patch on the photoconductive drum 14 with cyan toner. Then, in step S147 the CPU judges if 100 milliseconds are elapsed after the cyan developer carrier 31C starts developing a toner patch with cyan toner. If the answer is YES in step S147, the cyan developer carrier 31C completes the development for the toner patch with cyan toner in step S148. After step S148, the optical sensor 24 measures the amount of cyan toner on the toner patch. Similarly, four superimposed color toner images and the cyan toner patch are formed on the intermediate transfer belt 15 as illustrated in FIG. 7D. After transferring the four superimposed color images to the transfer sheet 19 by the transfer rollers 18, the residual toner and the cyan toner patch on the intermediate transfer belt 15 are cleaned by the belt cleaning device 45.

Thereby, four copies of the same four-color toner image are obtained. As illustrated in FIGS. 7A through 7D, a single toner patch is formed during image forming operations for a four-color reproduction. As a result, toner patches of each color are not superimposed on the intermediate transfer belt 15, so the cleaning failure and vibration of the cleaning blade of the belt cleaning device 45 do not occur on the intermediate transfer belt 15.

Figure 8A:
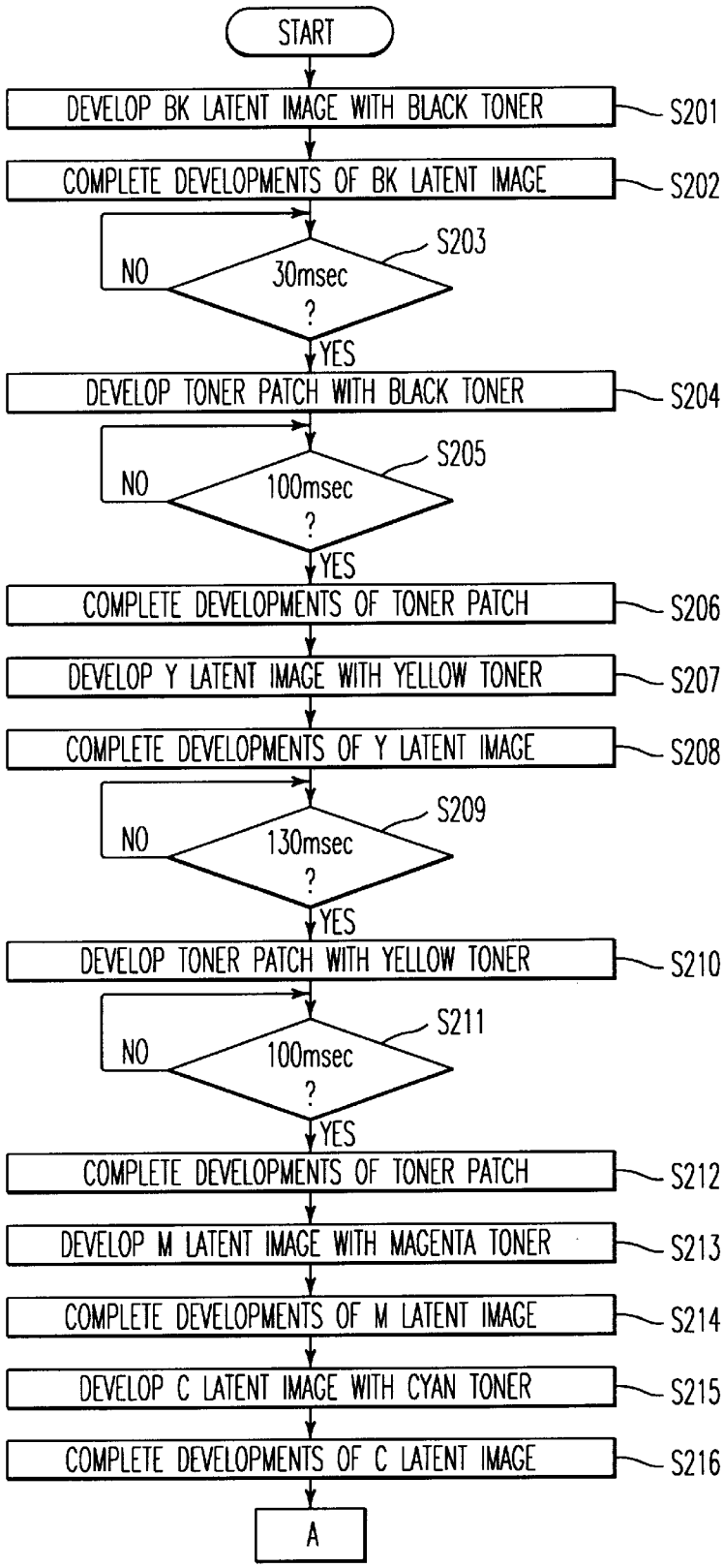
FIG. 8 is a flowchart of developing process steps when two copies of the same four-color toner image are formed according to a third embodiment of the present invention.
Figure 8B:
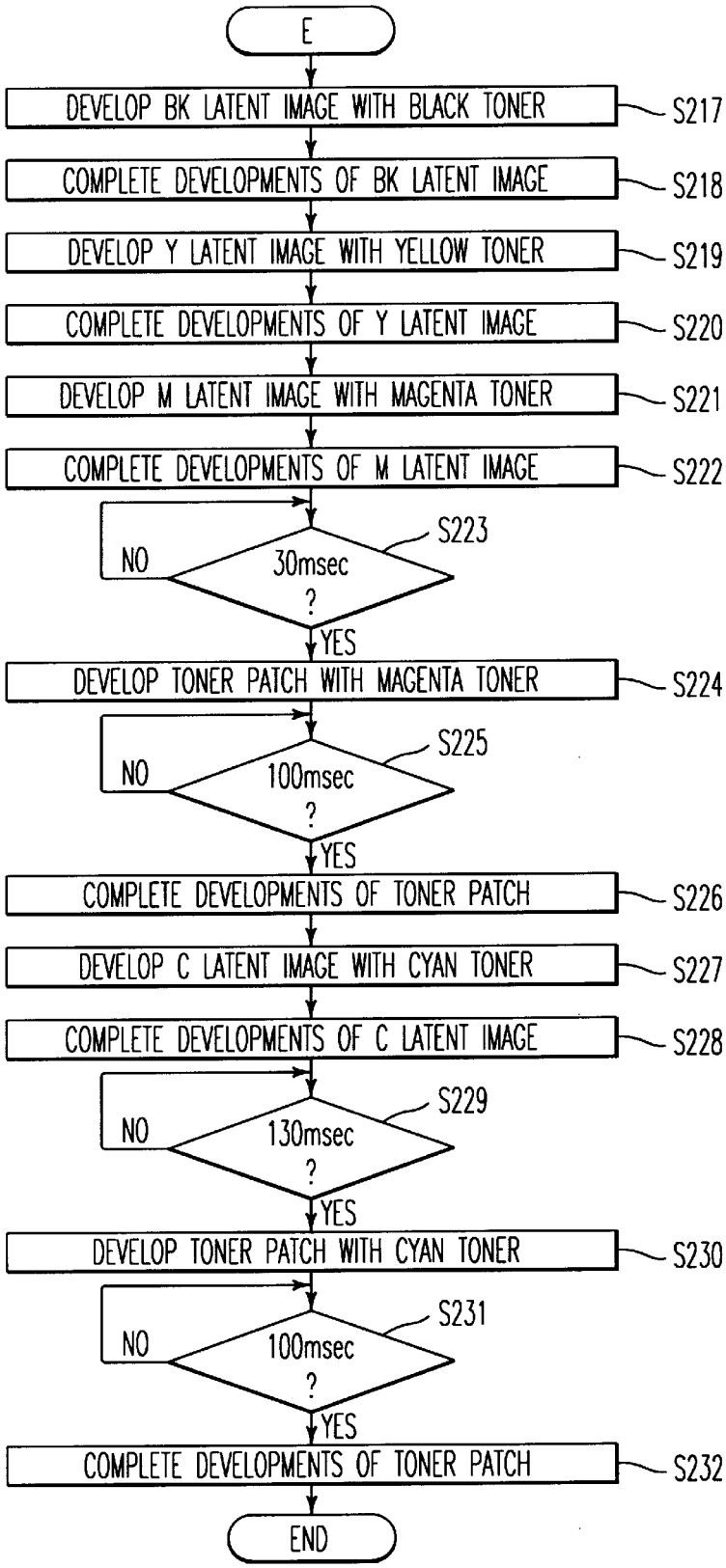

A third embodiment of the present invention will be described referring to FIGS. 8 and 9. FIG. 8 is a flowchart of developing process steps in which plural color patches are formed in producing a multi-color copy, and particularly as shown, two color patches are formed each time a four-color toner image is formed.

Figure 9A:
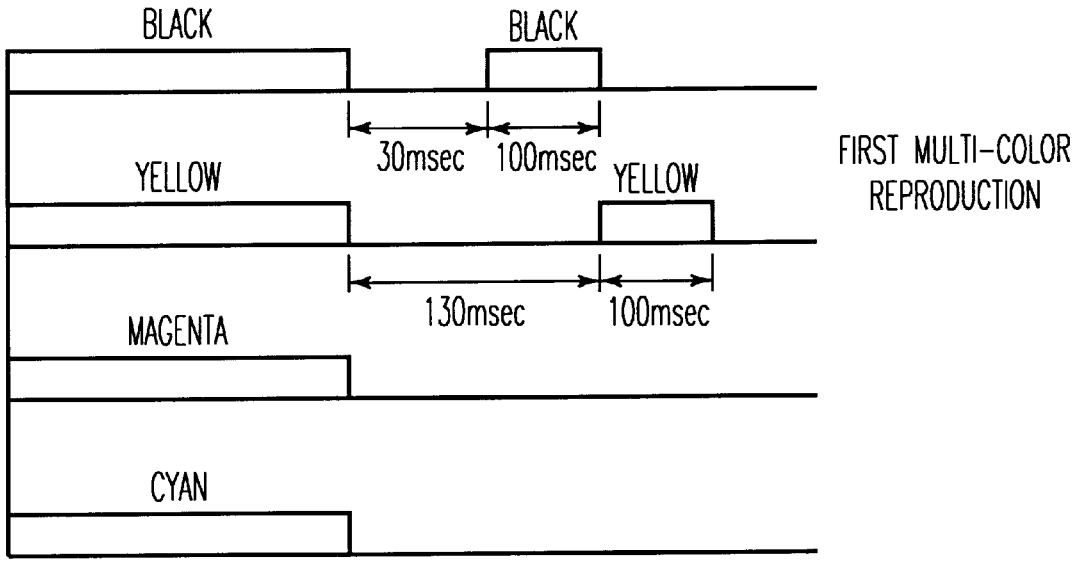
FIGS. 9A and 9B are timing charts of developing process according to the third embodiment of the present invention.

In the third embodiment, after a copying operation starts, developing operations are performed for a Bk latent image in steps S201 and S202. Then, in step 203 the CPU judges if 30 milliseconds are elapsed after the black developer carrier 31Bk completes the developments in step S202. If the answer is YES in step S203, the black developer carrier 31Bk starts developing a toner patch on the photoconductive drum 14 with black toner in step S204. Then, in step S205 the CPU judges if 100 milliseconds are elapsed after the black developer carrier 31Bk starts developing a toner patch with black toner. If the answer is YES in step S205, the black developer carrier 31Bk completes the development for the toner patch with black toner in step S206. After step S6, the optical sensor 24 measures the amount of black toner on the toner patch. Next, developing operations for an Y latent image are performed in steps S207 and S208. After step S208, in step S209 the CPU judges if 130 milliseconds are elapsed after the yellow developer carrier 31Y completes the development. If the answer is YES in step S209, the yellow developer carrier 31Y starts developing a toner patch on the photoconductive drum 14 with yellow toner in step S210. Then, in step S211 the CPU judges if 100 milliseconds are elapsed after the yellow developer carrier 31Y starts developing a toner patch with yellow toner. If the answer is YES in step S211, the yellow developer carrier 31Y completes the development for the toner patch with yellow toner in step S212. After step S212, the optical sensor 24 measures the amount of yellow toner on the toner patch. Then, developing operations are performed for M and C latent images successively in steps S213 through S216. Magenta and cyan toner patches are not formed in the developing operations for M and C latent images. After transferring from the photoconductive drum 14 to the intermediate transfer belt 15, four superimposed color toner images and black and yellow toner patches are formed on the intermediate transfer belt 15 as illustrated in FIG. 9A. Thereafter, the superimposed four color toner images are transferred to the transfer sheet 19 by the transfer rollers 18. The residual toner and the black and yellow toner patches on the intermediate transfer belt 15 are cleaned by the belt cleaning device 45.

Figure 9B:
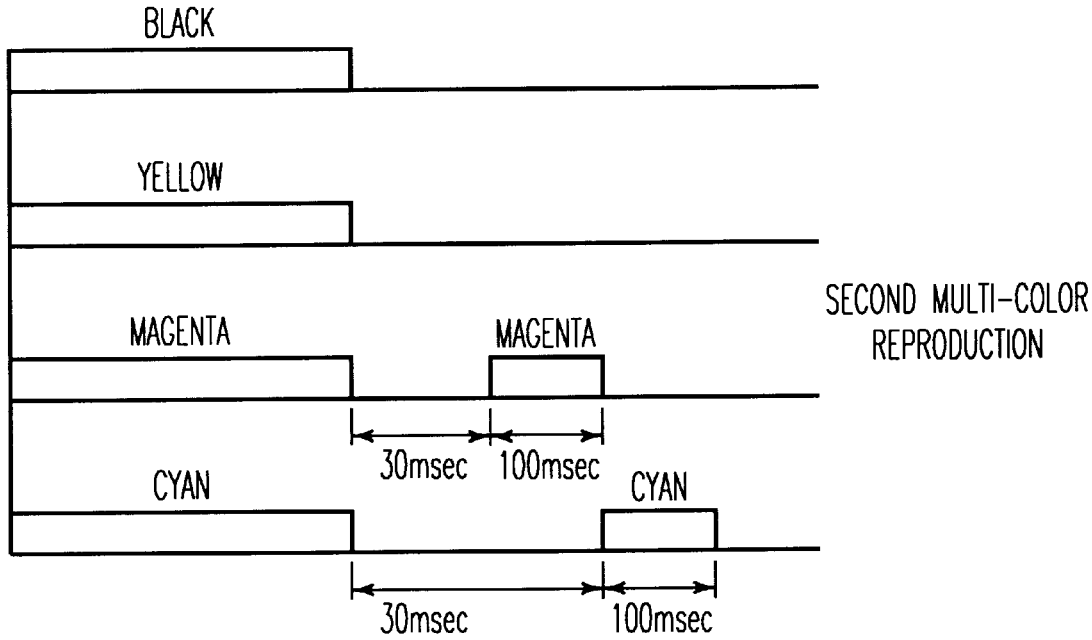

Next, the developing process for the second copy continues from step S217 to step S232. Developing operations are performed for Bk, Y, and M latent images successively in steps S217 through S222. After step S222, in step S223 the CPU judges if 30 milliseconds are elapsed after the magenta developer carrier 31M completes the development in step S222. If the answer is YES in step S223, the magenta developer carrier 31M starts developing a toner patch on the photoconductive drum 14 with magenta toner in step S224. Then, in step S225 the CPU judges if 100 milliseconds are elapsed after step S224. If the answer is YES in step S225, the magenta developer carrier 31M completes the development for the toner patch with magenta toner in step S226. After step S226, the optical sensor 24 measure the amount of magenta toner on the toner patch. Then, the developing operations are performed for a C toner image in steps S227 and S228. After step S228, in step S229 the CPU judges if 130 milliseconds are elapsed after the cyan developer carrier 31C completes the development. If the answer is YES in step S229, the cyan developer carrier 31C starts developing a toner patch on the photoconductive drum 14 with cyan toner in step S230. Then, in step S231 the CPU judges if 100 milliseconds are elapsed after step S230. If the answer is YES in step S231, the cyan developer carrier 31C completes the development for the toner patch with cyan toner in step S232. After step S232, the optical sensor 24 measures the amount of cyan toner on the toner patch. Thereby, four superimposed color toner images and magenta and cyan toner patches are formed on the intermediate transfer belt 15 as illustrated in FIG. 9B. The four superimposed color toner images are transferred to the transfer sheet 19 by the transfer rollers 18, and then the residual toner and the magenta and cyan toner patches on the intermediate transfer belt 15 are cleaned by the belt cleaning device 45.

As illustrated in FIGS. 9A and 9B, a pair of toner patches of two colors out of four is formed during one copy operation, and is laid in line on the intermediate transfer belt 15. Any pair of color is applicable for toner patches in the third embodiment.

Because the toner patches of each color are not superimposed on the intermediate transfer belt 15, the load on the belt cleaning device 45 is avoided.

Further, in the second and third embodiments, because the length of toner patch transferred to the intermediate transfer belt 15 in the intermediate transfer belt 15 moving direction is smaller than that of the first embodiment, the length of the intermediate transfer belt 15 can be reduced and the image forming apparatus can be accordingly compact.

Figure 10:
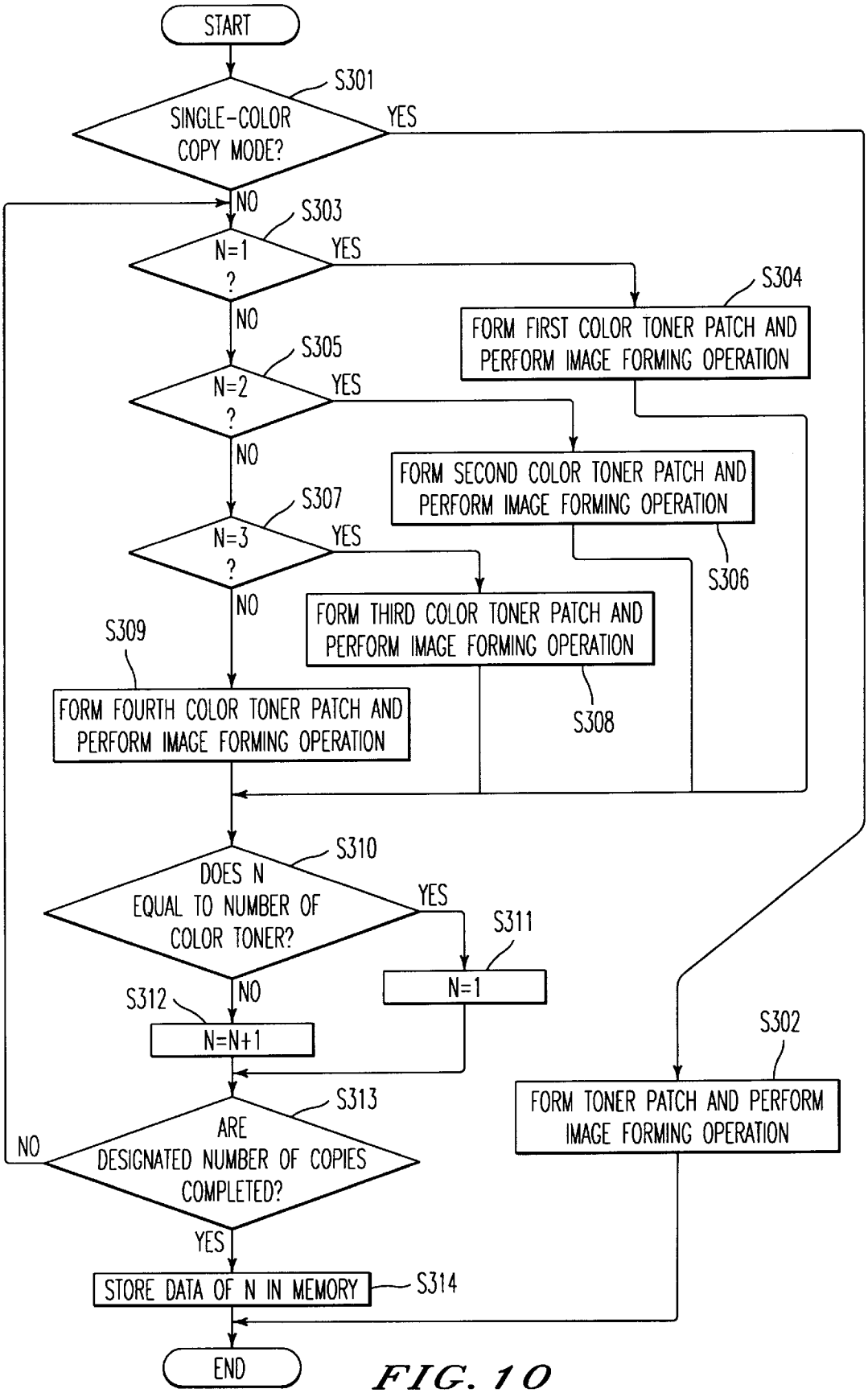
FIG. 10 is a flowchart of toner patch and image forming operation steps when a single-color copy or a four-color copy is performed according to the second embodiment of the present invention, and particularly illustrates control of color selection of color patches in successive multi-color reproductions.

FIG. 10 is a flowchart of toner patch and image forming operation steps when a single-color copy or a four-color copy is performed. FIG. 10 illustrates in particular how selection of color for color patches is controlled during successive reproductions of multi-colored original images. In each four-color copy mode, a single color toner patch is formed during image forming operations for a four-color reproduction as described in FIGS. 5 through 7 in the second embodiment of the present invention. The color of the color patch is changed in order during successive four-color reproductions. Further, in the four-color copy mode, data for a number corresponding to the order of colors of toner patch developed on the photoconductive drum 14 (the above-described number is hereinafter referred to as N) is stored in a nonvolatile memory.

After a copying operation starts, the CPU judges if a copy mode is single-color copy mode or not in step S301. If the answer is YES in step S301, a toner patch is formed and an image forming operation is performed in step S302. After step S302, a single-color copy operation mode ends. In a single-color copy mode, a toner patch may be formed every time image forming operation for one copy is performed or at one time out of two image forming operations for two copies. If the answer is NO in step S301, the CPU judges if N is one or not in step S303. If the answer is YES in step S303, the first color toner patch (i.e., black toner patch in the second embodiment) is formed and image forming operations for a four-color reproduction are performed in step S304. After step S304, the CPU judges if N is equal to the number of color toners (i.e., four) or not in step S310. If the answer is NO in step S310 (N is currently one in the example shown), the CPU changes N by adding one in step S313 (i.e., N then becomes two). Then, in step S313 the CPU judges if a designated number of copies are completed or not. If the answer is NO in step S313, the toner patch and image forming operations return to reexecute step S303.

Because N is then currently two, the toner patch and image forming operations proceed to step S305. In step S305, the CPU judges if N is two or not. If the answer is YES in step S305, the second color toner patch (i.e., yellow toner patch) is formed and image forming operations for a four-color reproduction are performed in step S306. After step S306, in step S310 the CPU judges if N is equal to the number of color toners (i.e., four) or not. If the answer is NO in step S310 (N is then currently two), the CPU changes N by adding one in step S312 (i.e., N then becomes three). Then, the CPU judges if the designated number of copies are completed or not in step S313. If the answer is NO in step S313, the toner patch and image forming operations return to reexecute step S303.

Because N is then currently three, the toner patch and image forming operations proceed to step S307. In step S307, the CPU judges if N is three or not. If the answer is YES in step S307, the third color toner patch (i.e., magenta toner patch) is formed and image forming operations for a four-color reproduction are performed in step S308. After step S308, the CPU judges if N is equal to the number of color toner (i.e., four) or not in step S310. If the answer is NO in step S310 (N is then currently three), the CPU changes N by adding one in step S312 (i.e., N then becomes four). Then, the CPU judges if a designated number of copies are completed or not in step S313. If the answer is NO in step S313, the toner patch and image forming operations return to reexecute step S303.

Because N is currently four, the toner patch and image forming operations proceed to step S309. In step S309, the fourth color toner patch (i.e., cyan toner patch) is formed and image forming operations for a four-color reproduction are performed in step S309. After step S309, the CPU judges if N is equal to the number of color toners (i.e., four) or not in step S310. If the answer is YES in step S310 (N is then four), the CPU resets N to one in step S311. After step S311, the CPU judges if the designated number of copies are completed or not in step S313. If the answer is YES in step S313, the CPU stores the data of N in a nonvolatile memory. For example, when the designated number of copies are completed in step S313 after N is changed to three in step S312, the data of N (i.e., three) is stored in the nonvolatile memory and a next copy will start such that the third color toner patch (i.e., magenta toner patch) is formed and image forming operations for a four-color reproduction are performed. According to the above-described embodiment, the color toner patch is formed in order during successive multi-color reproductions, regardless of a number of copies being produced.

Further, even if a two-color copy mode or a three-color copy mode is performed between a four-color copy mode operation, a color toner patch will be formed in order by adding the following step after starting copying operation. That is, the CPU judges if the copying mode is changed or not. If the answer is YES, the data of N in the nonvolatile memory is reset to one, and the first color toner patch, whose color is preset according to the copy mode, is formed, and latent image forming operations for each multi-color original image are performed a number of times corresponding to the number of colors to be reproduced. Color patches can be produced corresponding to each color latent image, as in the first embodiment, or a few number of color patches that the number of latent color images can be formed as per the second embodiment, and the color of the color patch changed in order during successive multi-color copying operations.

Figure 11:
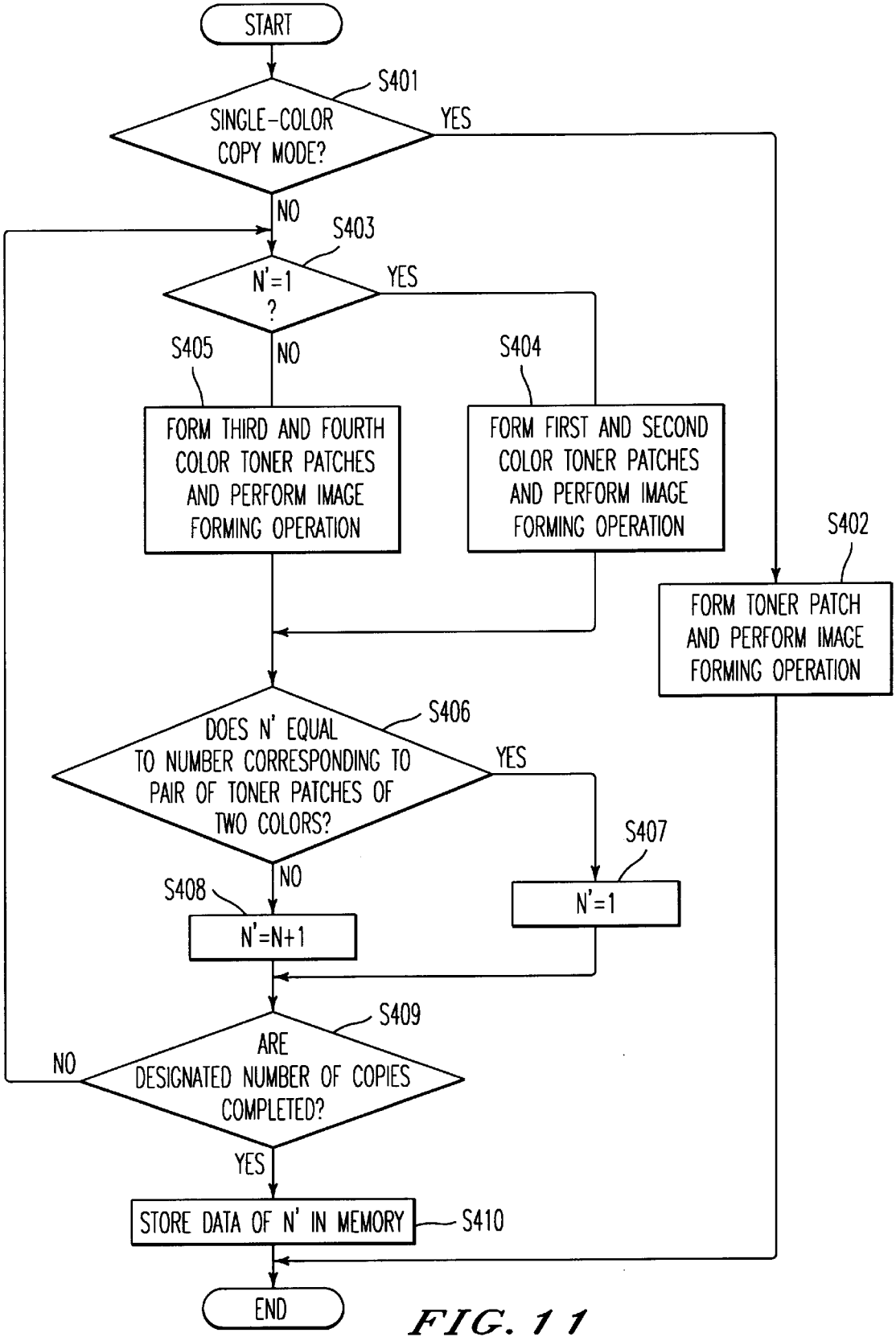
FIG. 11 is a flowchart of toner patch and image forming operation steps when a single-color copy or a four-color copy is performed according to a further embodiment of the present invention.

Referring to FIG. 11, a further embodiment of the present invention will be described.

FIG. 11 is a flowchart of toner patch and image forming operation steps when a single-color copy or a four-color copy is performed. In this embodiment, in a four-color copy mode, a pair of color toner patches is formed during image forming operations for a four-color reproduction as described in FIGS. 8 and 9 in the third embodiment of the present invention. In the embodiment of FIG. 11, data for a number corresponding to a pair of toner patches of two colors (the above-described number is hereinafter referred to as N') is stored in a nonvolatile memory.

After a copying operation starts, the CPU judges if a copy mode is single-color copy mode or not in step S401. If the answer is YES in step S401, a toner patch is formed and an image forming operation is performed in step S402. After step S402, a single-color copy operation mode ends. If the answer is NO in step S401, the CPU judges if the N' is one or not in step S403. If the answer is YES in step S403, the first and second color toner patches (i.e., black and yellow toner patches in the third embodiment) are formed during image forming operations for a four-color reproduction in step S404. After step S404, in step 406 the CPU judges if N' is equal to the number of pairs of color toner patch (i.e., two) or not. If the answer is NO in step S406 (N' is then currently one), the CPU changes N' by adding one in step S408. Then, the CPU judges if a designated number of copies are completed or not in step S409. If the answer is NO in step S409, the toner patch and image forming operations return to reexecute step S403.

Because N' is then currently two, the toner patch and image forming operations proceed to step S405. In step S405, the third and fourth color toner patches (i.e., magenta and cyan toner patches in the third embodiment) are formed during image forming operations for a four-color reproduction. After step S405, the CPU judges if N' equals to the number of pairs of color toner patch (i.e., two) or not in step S406

If the answer is YES in step S406 (N' is then two), the CPU resets N' to one in step S407. After step S407, the CPU judges if a designated number of copies are completed or not in step S409. If the answer is YES in step S409, the CPU stores the data of N' in the nonvolatile memory. In this embodiment, any pair of colors is applicable for toner patches.

As described above, the toner patches developed with four-color toner are not superimposed on the intermediate transfer belt 15 in the several embodiments of the present invention. As a result, the belt cleaning device 45 removes the toner patches adequately without causing cleaning failure and vibration of the cleaning blade.

Further, because the belt cleaning device 45 does not have excessive load due to the toner patches, the durability of the belt cleaning device 45 is increased.

Further, because the toner patches are formed in a line in the rotational direction of the photoconductive drum 14, the toner density of the toner patches can be measured by only one optical sensor 24. Therefore, the toner density detecting device can be implemented simply and at low cost.

The present invention further includes a computer readable medium storing program instructions by which the method of the invention can be performed when the stored program instructions are appropriately loaded into a computer, and a system for implementing the method of the invention.

In particular, the mechanisms and processes set forth in the present description may be implemented by a controller 60 schematically shown in FIG. 1. Controller 60 can be a conventional general purpose microprocessor or computer programmed according to the teachings in the present specification, as will be appreciated by those skilled in the relevant art(s). Appropriate software coding can readily be prepared by skilled programmers based on the teachings of the present disclosure, as will also be apparent to those skilled in the relevant art(s). However, as will be readily apparent to those skilled in the art, the present invention also may be implemented by the preparation of application-specific integrated circuits or by interconnecting an appropriate network of conventional component circuits.

The present invention thus also includes a computer program product 65, also schematically shown in FIG. 1, which may be hosted on a storage medium and include instructions which can be used to the controller 65 to perform processes in accordance with the present invention. The computer program product 65 can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Numerous modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A multi-color image forming apparatus comprising:

a first image bearing member;

a latent image forming device configured to form color original latent images corresponding to a multi-color original image and color patch latent images on the first image bearing member;

a plurality of color developing units that respectively develop the color original latent images and patch latent images formed on the first image bearing member so as to form respective color toner images and color toner patches;

a second image bearing member configured to have transferred thereto from the first image bearing member the color toner images and the color toner patches;

a toner density control device configured to control toner density of toner in the color developing units in relation to the color toner patches;

a transfer device configured to transfer the color toner images from the second image bearing member to an image carrier;

a cleaning device configured to clean the second image bearing member of toner upon completion of copying each multi-color original image; and a controller configured to control the latent image forming device and the color developing units such that the color toner images are superimposed on the second image bearing member and the color toner patches are not superimposed on the second image bearing member.

2. The apparatus of claim 1, wherein the controller is configured to control the latent image forming device and the developing units such that respective color toner patches are formed corresponding to each color toner image on the first image bearing member, and the toner patches are transferred spatially separated onto the second image bearing member.

3. The apparatus of claim 1, wherein the controller is configured to control the latent image forming device and the developing units such that a number of color toner patches formed on the first image bearing member during copying of said multi-color original image is less than a number of color toner images for said multi-color original image, and the toner patches are transferred spatially separated onto the second image bearing member.

4. The apparatus of claim 1, wherein the controller is configured to control the latent image forming device and the developing units such that, for each copy of a multi-color original image, at least one color toner patch is formed, and in forming plural copies of multi-color original images, the color of the color toner patch is changed in order.

5. The apparatus of claim 1, wherein the controller is configured to control the latent image forming device and the developing units such that, for each copy of a multi-color original, plural color toner patches of different colors are formed and transferred spatially separated onto the second image bearing member, and in forming plural copies of the multi-color original image, the colors of the plural toner patches are changed in order.

6. The apparatus of claim 1, wherein the controller is configured to control the latent image forming device and the developing units such that in copying the multi-color original image, plural color toner images are formed superimposed on the second image bearing member, a single color toner patch is formed on the second image bearing member, and the color of the single color toner patch is changed in order during copying of successive multi-color original images.

7. The apparatus of any one of claims 3, 4, 5 or 6, wherein said controller comprises:

a memory configured to store data corresponding to a color of toner patch that is lastly formed, and to determine a color of a next color toner patch produced in a next copying operation.

8. A multi-color image forming method, comprising:

(a) forming original latent images corresponding to respective colors of a multi-color original image and patch latent images on a first image bearing member;

(b) developing the original and patch latent images formed on the first image bearing member with respectively colored toners so as to form respective color toner images and color toner patches;

(c) transferring the color toner images and color toner patches from the first image bearing member onto a second image bearing member;

(d) controlling toner density of toner used in developing the original and patch latent images in relation to the color toner patches;

(e) controlling steps (a), (b) and (c) such that color toner images of different toner colors are transferred superimposed and color toner patches are transferred non-superimposed onto the second image bearing member;

(f) transferring the superimposed color toner images from said second image bearing member to an image carrier; and (g) cleaning the second image bearing member of toner upon completion of copying of each multi-color original image.

9. The method of claim 8, wherein step (e) comprises:

controlling steps (a), (b) and (c) in copying the multi-color original image such that respective color toner patches are formed corresponding to each color toner image on the first image bearing member and the color toner patches are transferred spatially separated onto the second image bearing member.

10. The method of claim 8, wherein step (e) comprises:

controlling steps (a), (b) and (c) such that in copying a multi-color origianl image, a number of color toner patches formed on the first image bearing member is less than a number of color toner images.

11. The method of claim 8, wherein step (e) comprises:

controlling steps (a), (b) and (c) such that, for each copy of a multi-color original image, at least one color toner patch is formed, and in successive reproducing of multi-color original images, the color of the at least one toner patch is changed in order.

12. The method of claim 8, wherein step (e) comprises:

controlling steps (a), (b) and (c) such that, for each copy of a multi-color original image, plural color toner patches are formed, and in reproducing plural multi-color original images, the color of the plural color toner patches is changed in order.

13. The method of claim 8, wherein step (e) comprises:

controlling steps (a), (b) and (c) in copying the multi-color original image such that plural color toner images are formed superimposed on the second image bearing member, a single color toner patch is formed on the second image bearing member, and the color of the single color toner patch is changed in order during reproduction of successive multi-color original images.

14. The method of any one of claims 10, 11, 12 or 13, wherein step (e) comprises:

storing in a memory data corresponding to a color of toner patch that is lastly formed, and determining a color of a next color toner patch produced in a next copying operation based on the data stored in said memory.

15. A computer program product which stores computer program instructions which when executed by a computer results in a multi-color image forming operation, comprising:

(a) forming original latent images corresponding to respective colors of a multi-color original image and patch latent images on a first image bearing member;

(b) developing the original and patch latent images formed on the first image bearing member with respectively colored toners so as to form respective color toner images and color toner patches;

(c) transferring the color toner images and color toner patches from the first image bearing member onto a second image bearing member;

(d) controlling toner density of toner used in developing the original and patch latent images in relation to the color toner patches;

(e) controlling steps (a), (b) and (c) such that color toner images of different toner colors are transferred superimposed and color toner patches are transferred non-superimposed onto the second image bearing member;

(f) transferring the superimposed color toner images from said second image bearing member to an image carrier; and (g) cleaning the second image bearing member of toner upon completion of copying of each multi-color original image.

16. The computer program product of claim 15, wherein step (e) comprises:

controlling steps (a), (b) and (c) in copying the multi-color original image such that respective color toner patches are formed corresponding to each color toner image on the first image bearing member and the color toner patches are transferred spatially separated onto the second image bearing member.

17. The computer program product of claim 15, wherein step (e) comprises:

controlling steps (a), (b) and (c) such that in copying a multi-color original image, a number of color toner patches formed on the first image bearing member is less than a number of color toner images.

18. The computer program product of claim 15, wherein step (e) comprises:

controlling steps (a), (b) and (c) such that, for each copy of a multi-color original image, at least one toner patch is formed, and in successive reproducing of multi-color original images, the color of the at least one toner patch is changed in order.

19. The computer program product of claim 15, wherein step (e) comprises:

controlling steps (a), (b) and (c) such that, for each copy of a multi-color original image, plural color toner patches are formed, and in reproducing plural multi-color original images, the color of the plural color toner patches is changed in order.

20. The computer program product of claim 15, wherein step (e) comprises:

controlling steps (a), (b) and (c) in copying the multi-color original image such that plural color toner images are formed superimposed on the second image bearing member, a single color toner patch is formed on the second image bearing member, and the color of the single color toner patch is changed in order during reproduction of successive multi-color original images.

21. The computer program product of any one of claims 17, 18, 19 or 20, wherein step (e) comprises:

storing in a memory data corresponding to a color of toner patch that is lastly formed, and determining a color of a next color toner patch produced in a next copying operation based on the data stored in said memory.

* * * * *